US006458013B1

(12) United States Patent
Saka et al.

(10) Patent No.: US 6,458,013 B1
(45) Date of Patent: Oct. 1, 2002

(54) METHOD OF CHEMICAL MECHANICAL POLISHING

(75) Inventors: Nannaji Saka, Cambridge; Jiun-Yu Lai, Waltham, both of MA (US); Hilario L. Oh, Rochester Hills, MI (US)

(73) Assignees: ASML US, Inc., Scotts Valley, CA (US); Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 09/628,962

(22) Filed: Jul. 31, 2000

(51) Int. Cl.[7] ..... B24B 49/14
(52) U.S. Cl. ..... 451/5; 451/41
(58) Field of Search ..... 451/5, 8, 9, 10, 451/288, 287, 41

(56) References Cited

U.S. PATENT DOCUMENTS

| | | | | | |
|---|---|---|---|---|---|
| 4,959,113 | A | | 9/1990 | Roberts | 156/636 |
| 5,069,002 | A | * | 12/1991 | Sandhu et al. | 451/5 |
| 5,676,587 | A | | 10/1997 | Landers et al. | 451/57 |
| 5,770,103 | A | | 6/1998 | Wang et al. | 252/79.1 |
| 5,840,629 | A | | 11/1998 | Carpio | 438/692 |
| 5,897,375 | A | | 4/1999 | Watts et al. | 438/693 |
| 5,954,997 | A | | 9/1999 | Kaufman et al. | 252/79.1 |
| 5,985,748 | A | | 11/1999 | Watts et al. | 438/622 |
| 6,001,730 | A | | 12/1999 | Farkas et al. | 438/627 |
| 6,046,111 | A | * | 4/2000 | Robinson | 438/693 |
| 6,062,952 | A | | 5/2000 | Robinson et al. | 451/41 |
| 6,063,306 | A | | 5/2000 | Kaufman et al. | 252/79.4 |
| 6,238,590 | B1 | * | 5/2001 | Fischer et al. | 216/88 |
| 6,257,953 | B1 | * | 7/2001 | Gitis et al. | 451/5 |
| 6,283,829 | B1 | * | 9/2001 | Molnar | 451/8 |

OTHER PUBLICATIONS

Adams, et al., "Process Control and Endpoint Detention with Fullscan ISRM System in Chemical Mechanical Polishing of Cu Layers," CMP–MIC, Mar. 2000, 5 pages.

Bonner et al., "Removal Rate, Uniformity and Defectivity Studies of Chemical Mechanical Polishing of BPSG Films," MRS, Spring 2000, 6 pages.

Garretson et al., "New Pad Conditioning Disk Design Delivers Excellent Process Performance While Increasing CMP Productivity," CMP Technology for ULSI Interconnection, SEMICON West 2000, 9 pages.

Osterheld et al., "A Novel Retaining Ring in Advanced Polishing Head Design for Significantly Improved CMP Performance," MRS, Apr. 5–9, 1999, 8 pages.

Römer et al., "STI CMP Using Fixed Abrasive Demands, Measurement Methods and Results," CMP–MIC, Mar. 2000, 10 pages.

Surana et al., "Defectivity Reduction in Copper CMP Processes," VMIC, Jun. 2000, 3 pages.

Tang, et al., "Novel Integrated Single Wafer Immersion Megasonics for Advanced Post CMP Cleaning in a Next Generation Dry–in Dry–out CMP System," CMP–MIC, Mar. 2000, 5 pages.

* cited by examiner

*Primary Examiner*—Robert A. Rose
(74) *Attorney, Agent, or Firm*—Dorsey & Whitney LLP

(57) ABSTRACT

In the Chemical Mechanical Polishing (CMP) process employed for microelectronics manufacturing, three contact regimes between the wafer surface and the polishing pad may be proposed: direct contact, mixed or partial contact, and hydroplaning. However, an effective in situ method for characterizing the wafer/pad contact and a systematic way of relating contact conditions to the process parameters are still lacking. In this work, the interfacial friction force, measured by a load sensor on the wafer carrier, has been employed to characterize the contact conditions. Models that relate the friction coefficient to the applied pressure, relative velocity, and slurry viscosity are developed and verified by experiments. Additionally, a correlation between friction coefficient and the material removal rate (MR) is established and the effects of process parameters on the Preston constant are investigated.

17 Claims, 8 Drawing Sheets

METHOD OF CHEMICAL MECHANICAL POLISHING

FIELD OF THE INVENTION

This invention relates generally to the field of chemical mechanical polishing (CMP) of semiconductor wafers or substrates. More specifically, the invention relates to a method of chemical mechanical polishing of semiconductor wafers or substrates.

BACKGROUND OF THE INVENTION

The ever-increasing demand for high-performance microelectronic devices has motivated the semiconductor industry to design and manufacture Ultra-Large-Scale Integrated (ULSI) circuits with smaller feature size, higher resolution, denser packing, and multi-layer interconnects. The ULSI technology places stringent demands on global planarity on multiple layers, called Interlevel Dielectric (ILD) layers, which comprise the circuit. Compared with other planarization techniques, the chemical mechanical polishing (CMP) process produces excellent local and global planarization at low cost, and is thus widely adopted in many back-end processes for planarizing inter-level dielectric layers, which are most often silicon dioxide ($SiO_2$). In addition to achieving global planarization, CMP is also critical to many emerging process technologies, such as the polishing of copper (Cu) damascene patterns, low-k dielectrics, and shallow trench isolation (STI) structures (Landis et al., 1992; Peters, 1998). The wide range of materials to be polished concurrently or sequentially, however, increases the complexity of the CMP process and necessitates an understanding of the process fundamentals for optimal process design and control.

Despite its extensive use in ULSI manufacturing, the basic material removal mechanisms in CMP are not yet well understood. Long ago, Preston empirically found in glass polishing that the material removal rate (MRR) is proportional to the product of the applied pressure and the relative velocity (Preston, 1927). The Preston equation may be written as $$\frac{d\xi}{dt} = k_p p v_R$$

where $\xi$ is the thickness of the layer removed, t the polishing time, p the nominal pressure, $v_R$ the relative velocity, and $k_p$ is a constant known as the Preston constant.

In recent years, it has been demonstrated in many works that the above relation is also valid for metals (Steigerwald et al., 1994; Stavreva et al., 1995 and 1997) and ceramics (Nakamura et al., 1985; Komanduri et al., 1996). To explain this proportionality, researches have attempted to study the material removal mechanisms during the CMP process, and several researchers have proposed particle abrasion (Brown et al., 1981; Liu et al., 1996) and pad asperity contact models (Yu et al., 1993) to elucidate the mechanical aspects of the CMP process. Assuming that wafer/abrasive or wafer/pad is in contact, the applied stress field near the wafer surface results in elastic-plastic deformation of the surface layer and produces wear. Another line of research has focused on the chemical mechanisms of the process (Cook, 1990; Luo et al., 1998). Cook first reviewed the chemical process for glass polishing. He suggested that both surface dissolution under particle impact and the absorption or dissolution of wear particles onto the slurry particles will determine the polishing rate of glass. More recently, a two-dimensional wafer-scale model based on lubrication theory (Runnels and Eyman, 1994) and mass transport has been proposed (Sundararajan et al., 1999). In this model, the wafer is assumed to hydroplane on the pad surface, and the normal load is supported by the hydrodynamic pressure of the viscous slurry film. The polishing rate is determined by the convective mass transport of the chemical species.

Whether material removal is by mechanical, chemical, or chemomechanical interactions in the CMP process, an understanding of the contact condition at the wafer/pad interface is important to process characterization, modeling, and optimization. However, to date there is no explicit methodology in the CMP literature to characterize wafer-scale interfacial conditions with process parameters. Some researchers have assumed that the wafer hydroplanes while being polished, and thus solve the Reynolds equation of lubrication to determine the relations among wafer curvature, applied pressure, relative velocity, slurry viscosity, slurry film thickness, and pressure distribution on the wafer surface (Runnel, 1994; Runnel and Eyman, 1994). Another group has assumed the wafer is in contact, or partially in contact with the pad, and relate the displacement of the wafer to the pad elastic modulus and solve the stress field by the classical contact mechanics model (Chekina et al., 1998). Measurement of the vertical displacement of the wafer relative to the pad seems the most direct prior art technique of identifying the contact condition and determine the slurry film thickness (Mess et al., 1997). However, the compliance of the pad material and that of the back film in the wafer carrier make such measurements unreliable. While some experiments in the hydroplaning mode have been conducted on smaller specimens (Nakamura et al., 1985), it is questionable to scale up the results to a larger size wafer. In general, different applied pressure, velocity, and other experimental conditions employed by the various investigators have resulted in a difficult situation to draw any definitive conclusions regarding the mode of interfacial contact. Thus, it is highly desirable to determine and characterize the primary material removal mechanism during CMW and to provide a CMU process that promote an increased material removal rate (MRR) from the surface of the wafer.

Relevant Literature

References discussing CMP processes in the semiconductor industry include:

Bhushan, M., Rouse, R., and Lukens, J. E., 1995, "Chemical-Mechanical Polishing in Semidirect Contact Mode," *J Electrochem. Soc.,* Vol. 142, pp. 3845–3851.

Bramono, D. P. Y., and Racz, L. M., 1998, "Numerical Flow-Visulization of Slurry in a Chemical Mechanical Planarization Process," *Proc.* 1998 *CMP-MIC Conf.*, pp. 185–192.

Brown, N. J., Baker, P. C., and Maney, R. T., 1981, "Optical Polishing of Metals," *Proc. SPIE,* Vol. 306, pp. 42–57.

Bulsara, V. H., Ahn, Y., Chandrasekar, S., Farris, T. N., 1998, "Mechanics of Polishing," ASME *Journal of, Applied Mechanics,* Vol. 65, pp. 410–416.

Chekina, O. G., Keer, L. M., and Liang, H., 1998, "Wear-Contact Problems and Modeling of Chemical Mechanical Polishing," *J. Electrochem. Soc.,* Vol. 145, pp. 2100–2106.

Cook, L. M., 1990, "Chemical Processes in Glass Polishing," *J. Non-Crystalline Solids*, Vol. 120, pp. 152–171.

Cook, L. M., Wang, F., James, D. B., and Sethuraman, A. B., 1995, "Theoretical and Practical Aspects of Dielectric and Metal Polishing," *Semiconductor International,* Vol. 18, pp. 141–144.

Komanduri, R., Umehara, N., and Raghanandan, M., 1996, "On the Possibility of Chemo-Mechanical Action in Magnetic Float Polishing of Silicon Nitride," ASME, *Journal of Tribology,* Vol. 118, pp. 721–727.

Kaufman, F. B., Thompson, D. B., Broadie, R. E., Jaso, M. A., Guthrie, W. L., Pearson, D. J., and Small, M. B., 1991, "Chemical-Mechanical Polishing for Fabricating Patterned W Metal Features as Chip Interconnects," *J. Electrochem. Soc.,* Vol. 138, pp. 3460–3464.

Landis, H., Burke, P., Cote, W., Hill, W., Hoffman, C., Kaanta, C., Koburger, C., Lange, W., Leach, M., Luce, S., 1992, "Intergration of Chemical-Mechanical Polishing into CMOS Integrated Circuit Manufacturing," *Thin Solid Films,* Vol. 220. pp. 1–7

Liu, C. -W., Dai, B. -T., Tseng, W. -T., and Yeh, C. -F., 1996, "Modeling of the Wear Mechanism during Chemical-Mechanical Polishing," *J. Electrochem. Soc.,* Vol. 143, pp. 716–721.

Luo, Q., Ramarajan, S., and Babu, S. V., 1998, "Modification of Preston Equation for the Chemical-Mechanical Polishing of Copper," *Thin Solid Films,* Vol. 335, pp. 160–167.

Nakamura, T., Akamatsu, K., and Arakawa, N., 1985, "A Bowl Feed and Double Sides Polishing for Silicon Wafer for VLSI," *Bulletin Japan Soc. Precision Engg.*, Vol. 19, pp. 120–125.

Peters, L., 1998, "Pursuing the Perfect Low-k Dielectric," *Semiconductor International,* Vol. 21, pp. 64–74.

Runnels, S. R., 1994, "Feature-Scale Fluid-Based Erosion Modeling for Chemical-Mechanical Polishing," *J. Electrochem. Soc.,* Vol. 141, pp. 1900–1904.

Runnel, S. R., and Eyman, L. M., 1994, "Tribology Analysis of Chemical-Mechanical Polishing," *J. Electrochem. Soc.,* Vol. 141, pp. 1698–1701.

Runnels, S. R., Kim, I., Schleuter, J., Karlsrud, C., and Desai, M., 1998, "A Modeling Tool for Chemical-Mechanical Polishing Design and Evaluation," *IEEE Tran. on Semiconductor Mfg.,* Vol. 11, pp. 501–510.

Stavreva, Z., Zeidler, D., Plotner, M., Drescher, K., 1995, "Chemical Mechanical Polishing of Copper for Multilevel Metallization," *Appl. Surface Sci.,* Vol. 91, pp. 192–196.

Stavreva, Z., Zeidler, D., Plotner, M., Grasshoff, G., Drescher, K., 1997, "Chemical-Mechanical Polishing of Copper for Interconnect Formation," *Microelectronic Engr.,* Vol. 33, pp. 249–257.

Steigerwald, J. M., Zirpoli, R., Murarka, S. P., Price, D., Gutmann, R. J., 1994, "Pattern Geometry Effects in the Chemical-Mechanical Polishing of laid Copper Structures," J *Electrochem. Soc.,* Vol. 141, pp. 2842–2848.

Sundararajan, S., Thakurta, D. G., Schwendeman, D. W., Murarka, S. P., and Gill, W. N., 1999, "Two-Dimensional Wafer-Sacle Chemical Mechanical Planarization Models Based on Lubrication Theory and Mass Transport," *J. Electrochem.* Soc., Vol. 146, pp. 761–766.

Yu, T. -K., Yu, C. C., and Orlowski, M., 1993, "A Statistical Polishing Pad Model for Chemical-Mechanical Polishing," *Proc.* 1993 *IEEE Int. Electron Dev. Mfg.,* pp. 865–868.

Zhao, B., and Shi, F. G., 1999, "Chemical Mechanical Polishing in IC Process: New Fundamental Insights," *Proc.* 1999 *CMP-MIC Conf,* pp. 13–22.

SUMMARY OF THE INVENTION

Accordingly, it is an object of the present invention to provide a method of chemical mechanical polishing (CMP) that promotes increased material removal rate (MRR). More particularly, it is an object of the present invention to provide a method which operates in a contact mode at the interface between the CMP polishing pad and the wafer or substrate surface. Further, the present invention provides a method which identifies preferred CMP process parameters for increasing the MRR.

As will be described in detail below, the inventors have discovered that to increase the material removal rate, the CMP process must be operated in the contact mode at the interface between the wafer and the polishing pad. Hydroplaning at the interface is not a stable process mode in terms of the gimbaling point location, wafer curvature, and fluctuations in slurry flow. Accordingly, the important issue in CMP process design is to select process parameters to maintain the process in the stable contact regime. Further, the inventors have discovered that, within the contact mode, preferred process parameters may be identified according to a mathematical derivation as described below.

In general, a method of chemical mechanical polishing a surface of a wafer with a polishing pad is provided, comprising the steps of: rotating any one or both of the polishing pad and the wafer at a relative velocity $v_R$; and urging the wafer and pad against each other at an applied pressure p, wherein the values of p and $v_R$ are such that the interface between the pad and the wafer are in the contact mode.

In another aspect of the present invention, a method of chemical mechanical polishing is provided where the following equation is satisfied:

$$v_R/P \approx C_1/\eta \quad (1)$$

where $v_R$ is the relative velocity of the polishing pad and the wafer, p is the pressure applied to the wafer, and $C_1$, is a constant that is related to the geometry of the polishing interface and machine design, and $\eta$ is the viscosity of the slurry used in the particular CMP process, as described further below.

In a further aspect of the present invention, a method of chemical mechanical polishing is provided wherein the interfacial friction coefficient is monitored during the CMP process to maintain the interface between the wafer and the pad in the contact mode, and preferably to maintain the CMP process at the preferred operating parameters. For example, method of chemical mechanical polishing a surface of a wafer with a polishing pad is provided comprising the steps of: rotating any one or both of the polishing pad and the wafer at a relative velocity $v_R$; urging the wafer and pad against each other at an applied pressure p; measuring the frictional forces generated by the pad and wafer during the polishing; determining the friction coefficient from said friction measurement; and controlling the values of p and $v_R$ to maintain the friction coefficient at a value of about 0.1 or greater during polishing.

BRIEF DESCRIPTION OF THE DRAWINGS

Other objects and advantages of the present invention will become apparent upon reading the detailed description of the invention and the appended claims provided below, and upon reference to the drawings, in which:

DETAILED DESCRIPTION OF THE INVENTION

The following nomenclature is used throughout the description of the present invention and is defined as:

| | | |
|---|---|---|
| $k_p$ | = | Preston constant ($m^2/N$) |
| P | = | the rate of thermal energy generation due to friction (W) |
| p | = | normal pressure on wafer ($N/m^2$) |
| $p^*$ | = | optimal normal pressure ($N/m^2$) |
| $r_p, r_w$ | = | distances between a given point on the wafer and the centers of the pad and the wafer (m) |
| $v_R{}^*$ | = | optimal relative velocity (m/s) |
| $v_R$ | = | magnitude of the relative velocity (m/s) |
| $\eta$ | = | viscosity of the slurry (Pa · s) |
| $\mu$ | = | Coulomb friction coefficient |
| $\mu_a, \mu_1, \mu_p$ | = | friction coefficients |
| $\xi$ | = | thickness of the material removed on wafer surface (m) |
| C | = | specific heat (J/kg · K) |

Figure 1A:
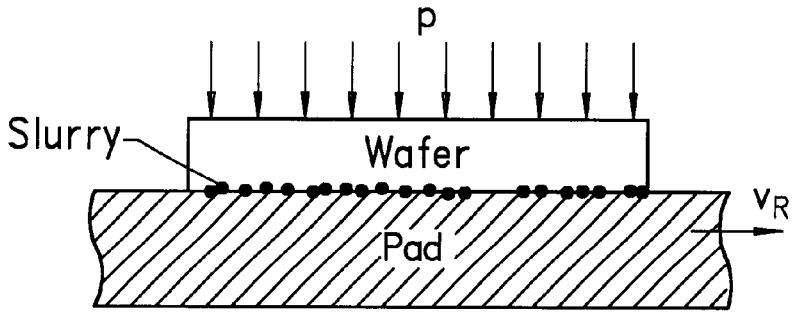
FIGS. 1A–1C are schematic diagrams of the wafer/pad interface at the contact mode, mixed mode and hydroplaning mode, respectively.
Figure 1B:
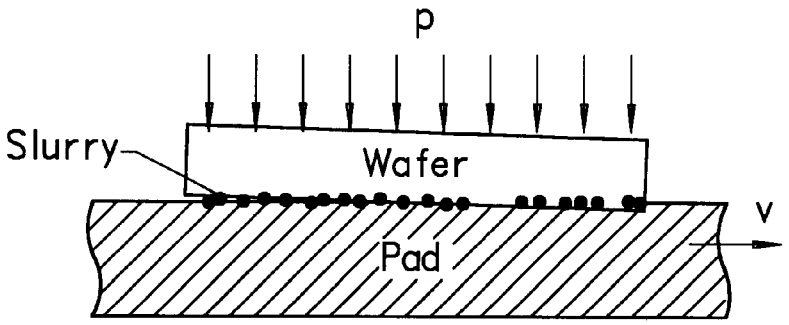
Figure 1C:
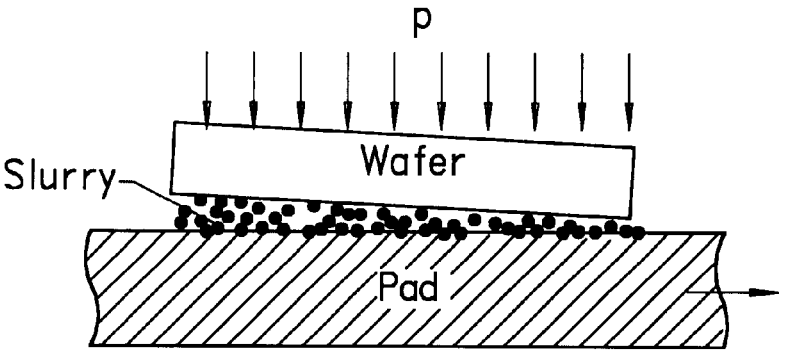

The inventors have discovered that the material removal rate (MRR) of the chemical mechanical polishing (CMP) process is improved when the process is carried out such that the interface condition between the wafer or substrate surface and the CMP polishing pad (wafer/pad interface) are in the contact mode or contact regime. In particular, as described in further detail below, during the CTMP process three modes may exist at the interface of the pad and wafer; namely, the contact, hydroplaning and mixed modes. Referring to FIGS. 1A to 1C, schematic diagrams illustrating the wafer/pad interface in the contact, mixed and hydroplaning modes, respectively, are shown. A CMP machine, such as those well known in the art, is used to polish the wafer or substrate. In general, the CMP machine usually includes one or more polishing stations which supports the polishing pad and a wafer carrier assembly which supports the wafer. One example of a CMP machine that may be used to practice the method of the present invention is described in U.S. patent application Ser. No. 09/628,563 filed simultaneously herewith, and incorporated by reference herein in its entirety. While one specific example is given, it will be understood by those of ordinary skill in the art that any suitable CMP machine may be used to practice the method of the present invention.

To planarize and/or polish the surface of the wafer, the wafer is urged against the polishing pad with an applied pressure p. The polishing pad has an abrasive surface and a slurry is typically placed on the pad to aid in material removal from the surface of the wafer. The wafer is typically rotated, and the polishing pad moves either linearly or may rotate as well, such that the wafer will experience a relative velocity $v_R$. When the wafer is pressed against the polishing pad and slid with an intervening fluid layer, the polishing slurry at the wafer/pad interface, the interfacial conditions can be characterized as: contact, hydroplaning and mixed mode. In the contact mode shown in FIG. 1A, the asperities of opposing surfaces, wafer/pad or wafer/particle, mechanically interact. Usually, the real contact area is much smaller than the nominal surface area. Plastic deformation occurs on both surfaces at the contact spots. In the contact mode, the intervening fluid film is discontinuous and no significant pressure gradient will be formed in the fluid film across the diameter of the wafer to support the normal load. This type of contact mode occurs in the CMP practice when the relative velocity is low or the applied pressure is high. Since a tangential force is required to shear the surface asperities, the friction coefficient is relatively higher than that of the other two modes. In the contact mode the friction coefficient is generally in the range of about 0.1 or greater.

In contrast, when the velocity is sufficiently high or the applied pressure is relatively low, the wafer will glide on a fluid film without directly touching the pad. This is the hydroplaning mode and is illustrated in FIG. 1C. Since there is no contact between the wafer and pad surfaces, the frictional force is due to the shear of the viscous fluid film, and the friction coefficient is expected to be much smaller than in the contact mode. In the hydroplaning mode the friction coefficient is found to be generally in the range of about 0.001 to 0.01. During polishing, pressure builds up in the viscous fluid film to support the normal load on the wafer. It may be noted that the pressure gradient is very sensitive to the wafer attack angle. A slight change of the attack angle, unsteady slurry flow, or a partial wafer/pad contact due to mechanical vibration, may result in a shift away from the hydroplaning mode even if the velocity and the normal pressure requirements are satisfied.

As a transition from the contact mode to the hydroplaning mode, the mixed mode will occur when the velocity is increased or the pressure reduced. hi this mixed regime shown in FIG. 1B, the velocity is neither high enough nor the pressure low enough to build up a thick fluid layer to support the normal load. This will result in some contact between the pad asperities and the wafer surface. The friction force is the weighted sum of the force necessary to deform the surface asperities at the wafer/pad and wafer/particle contacts, and that from the shear of the viscous slurry film. The friction coefficient in the mixed mode is generally in the range of about 0.01 and 0.1. The inventors have found that as the friction coefficient varies by one to two orders of magnitude among the different contact modes, the friction coefficient can be used as an indicator of the wafer/pad contact conditions.

The friction coefficient can be correlated to the Preston constant $k_p$. It is indicated that $k_p$ decreases significantly in the hydroplaning mode, and is not satisfactory in the mixed mode due to the large variation of $k_p$. Given this teaching, the present invention provides for carrying out the CMP process in the contact mode to increase the material removal rate at the surface of the wafer. The CMP process is carried out, and maintained substantially throughout, in the contact mode by operating at high $k_p$ regimes. In one embodiment, to carry out the CMP process in the contact mode, the method of the present invention provides for maximizing the product of the applied pressure and the relative velocity $pv_R$. A range of pressures and velocities are suitable according to the present invention. In particular, the applied pressure p is in the range of about 14 to 70 kPa, and more preferably in the range of about 14 to 57 kPa. The relative velocity $v_R$ is in the range of about 0.05 to 4.0 m/s, and more preferably in the range of about 0.4 to 2.0 m/s.

Figure 2:
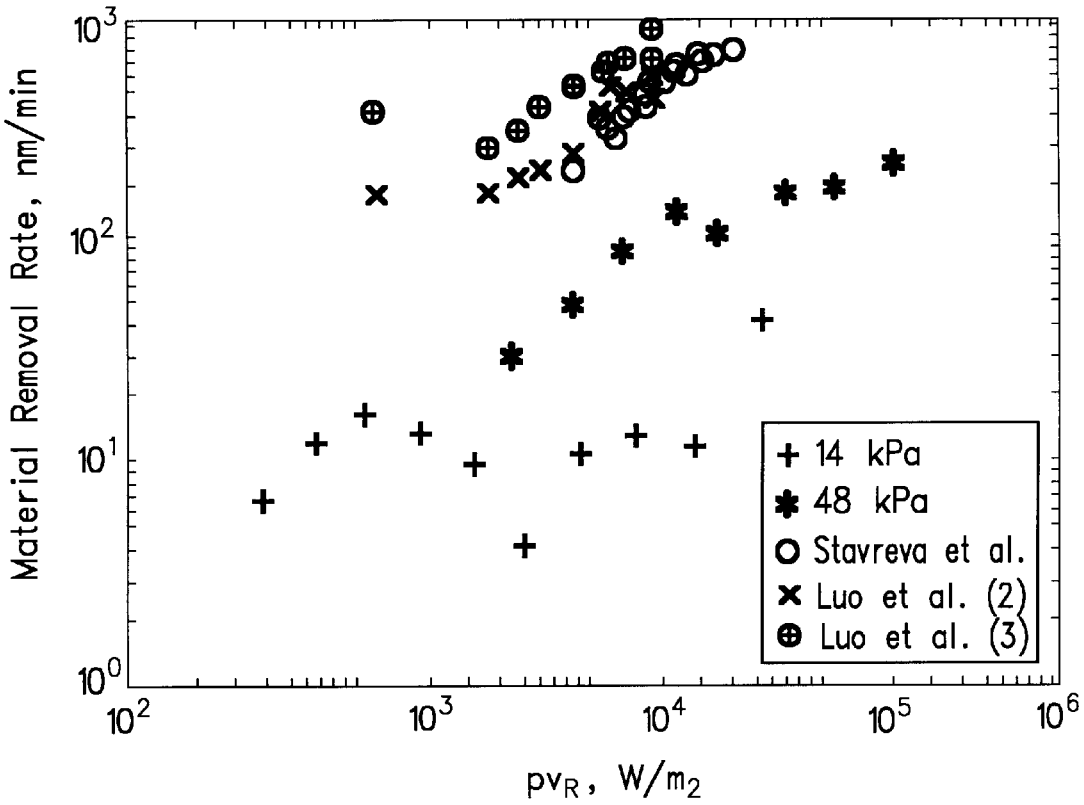
FIG. 2 is a graph showing the effect of the energy flux on Cu removal rate.
Figure 3:
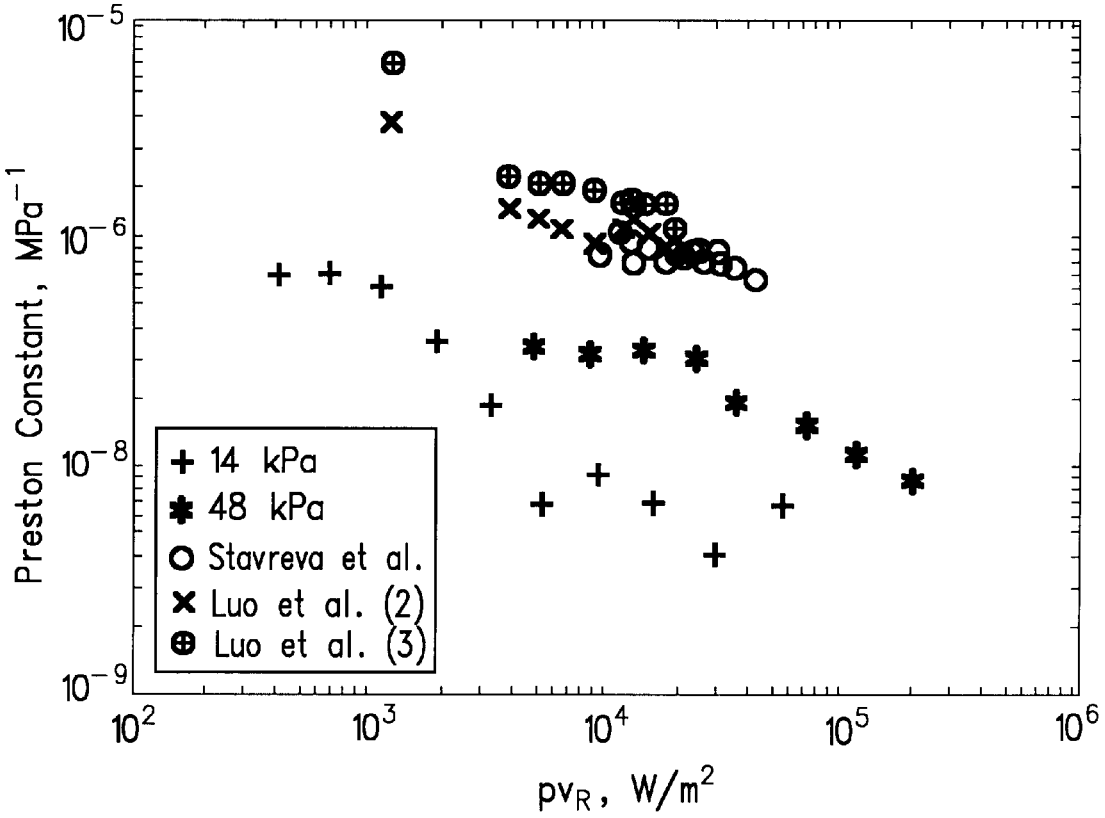
FIG. 3 is a graph illustrating the effect of the energy flux on the Preston constant.

To further understand the mechanism of the contact regime, we refer again to the Preston equation, Eq. (1). The material removal rate (OMRR) derived from experiments (the experiments are described indetail below), is plotted against the product $pv_R$ as shown in FIG. 2. Literature data on Cu polishing (Stavreva et al., 1995 & 97; Luo et al., 1998) are also included in the plot and the corresponding conditions are shown below in Table 6 in the Experimental section. It must be emphasized, however, that the present data are obtained with a neutral slurry over a wide range of $Pv_R$ values, whereas the literature data represent chemical mechanical polishing but over a narrow range of p and $v_R$. The mode of contact, however, should not depend on the chemistry of the slurry. Thus, if the mechanism of material removal is not affected by variation in p, $v_R$, or $pv_R$, the scatter in the data should be small and the slope of a line drawn through the data points is the Preston constant. The large scatter in the data clearly shows that the Preston constant is indeed not constant. FIG. 3 shows a plot of the Preston constant versus $pv_R$ for the present experimental data and those obtained from the literature. It is apparent that the data are widely scattered because the wafer/pad interface is not in contact for the majority of the $pv_R$ values.

Figure 4A:
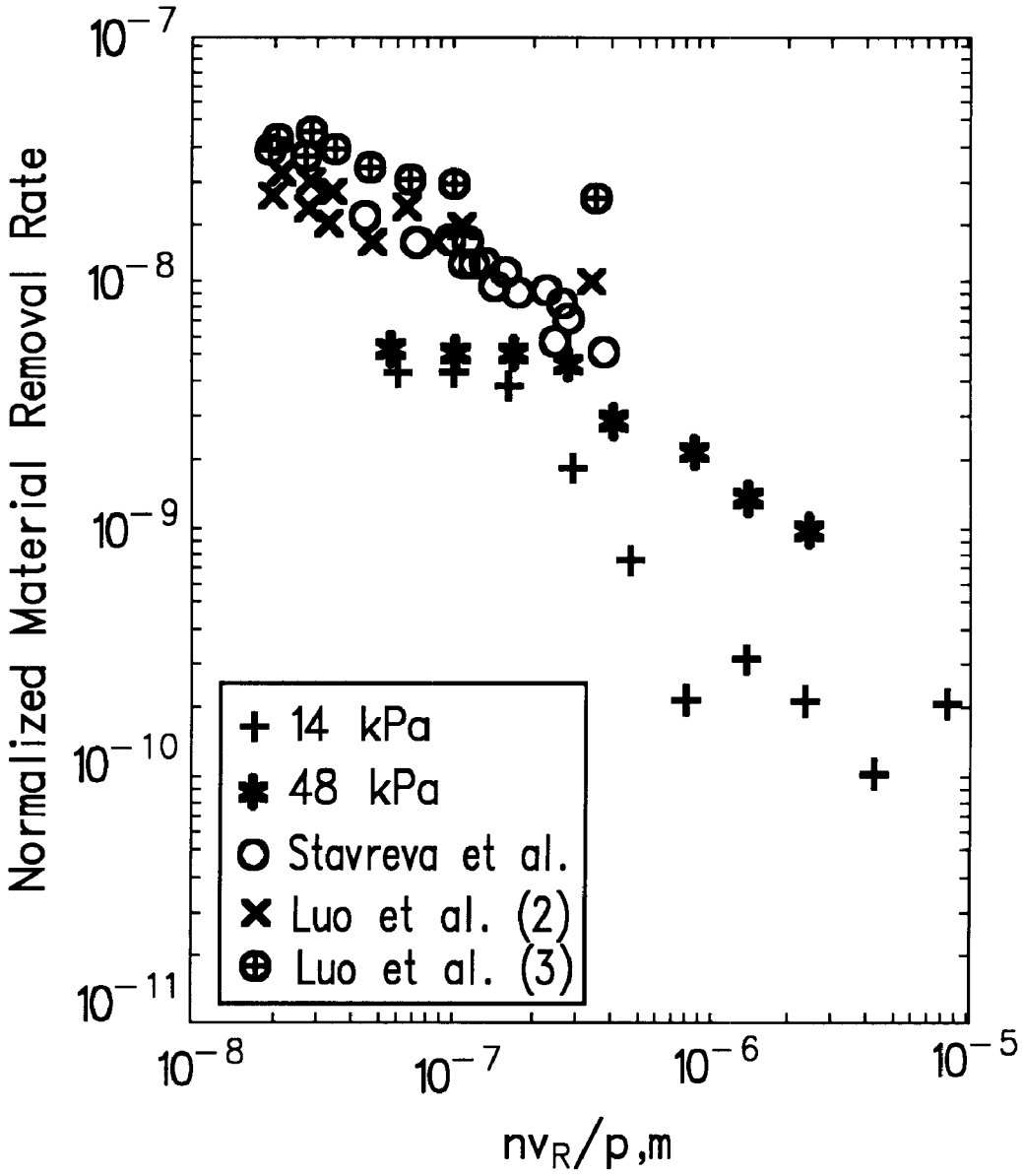
FIG. 4A shows the effect of the dimensional parameter on the normalized Cu removal rate.
Figure 4B:
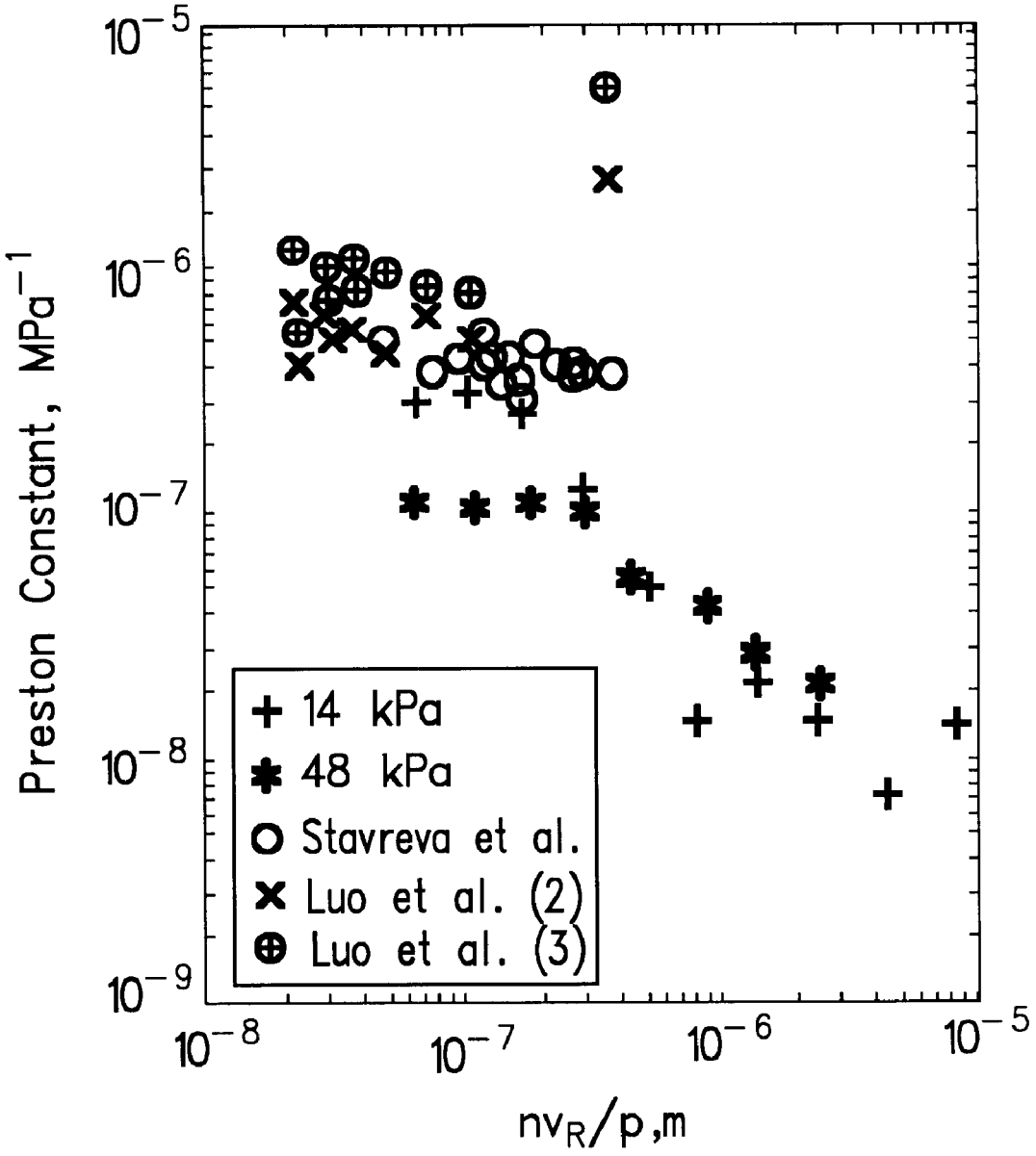
FIG. 4B illustrates the effect of the dimensional parameter on the Preston constant.
Figure 5:
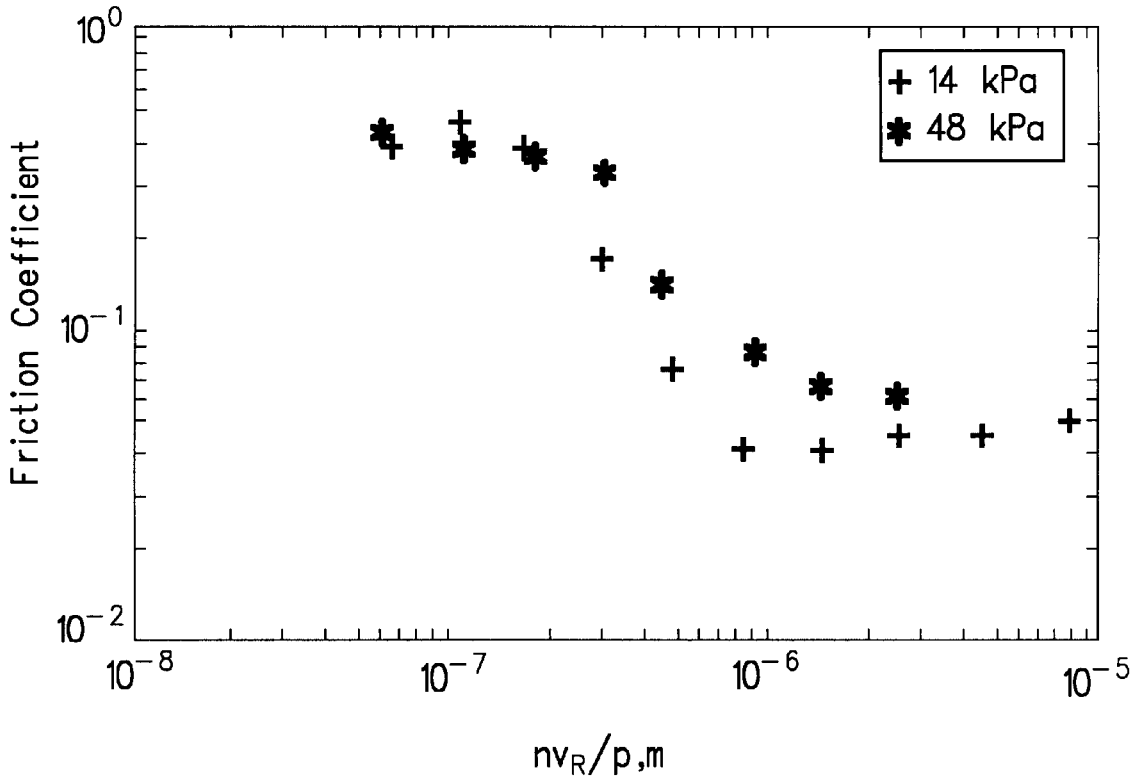
FIG. 5 is a graph illustrating the effect of the dimensional parameter on the friction coefficient.

Thus, to better delineate the effect of contact conditions, the normalized material removal rate, NMRR, and the Preston constant, $k_p$, is plotted in FIGS. 4A and 4B against a dimensional parameter $\eta v_R/p$ where $\eta$ is the viscosity of the slurry. NMRR is the thickness of material removed per unit distance slide, or $MRR/v_R$. It is apparent now that the NMRR and the Preston constant does not depend on the applied pressure and the velocity when $\eta v_R/p$ is small. It is about $0.2\times10^{-6}$ $MPa^{-1}$ at 14 kPa and $0.1\times10^{-6}$ $MPa^{-1}$ at 48 kPa. The Preston "constant" stays high at low $\eta v_R/p$ , i.e., in the contact mode, and drops down after the critical value, denoted as $(\eta v_R/p)_c$. The experimental results show that the transition occurs around the same $(\eta v_R/p)_c$ for both pressures. This implies that the Preston constant is independent of pressure and velocity when the wafer/pad interface is in the contact mode. After the transition point, the Preston constant decreases as $v_r$ is increased or p decreased. It is also apparent from that the Preston constant shows the same trend as that of friction coefficient (shown in FIG. 5), and the transition in $k_p$ occurs at about the same values of $\eta v_R/p$ . In the transition regime, the Preston constant is not independent of pressure and velocity. It is found that $k_p$ varies as $(\eta v_R/p)^{-1}$ at 14 kPa and as $(\eta v_R/p)^{-0.5}$ at 48 kPa in the mixed regime.

The variation of $k_p$ can be explained in terms of the shifting interfacial conditions as follows. In the mixed mode, the friction coefficient decreases with $\eta v_R/p$ which implies that the wafer/pad contact area also decreases with $\eta v_R/p$ . The lack of contact further reduces the material removal rate since the fluid shear and the motion of the loose particles in the discontinuous fluid film cannot apply sufficient pressure on the wafer surface and remove material. With increasing $\eta v_R/p$ , particle rolling will increase and particle translation will decrease. In fact, some researchers tried to fit their data numerically to account for the variation of Preston "constant" at low pressure or high velocity conditions by a polynomial function of the $Pv_R$ product (Zhao and Shi, 1999), or introduce extra pressure and/or velocity terms in Preston equation (Luo et al., 1998). They proposed that the interfacial shear stress and particle velocity will enhance the chemical reaction rate or mass transfer from the wafer surface. However, the variation in $k_p$ might just be due to the varying interfacial contact modes as FIG. 4A shows, and thus each contact mode is expected to have a different Preston constant.

Figure 6:
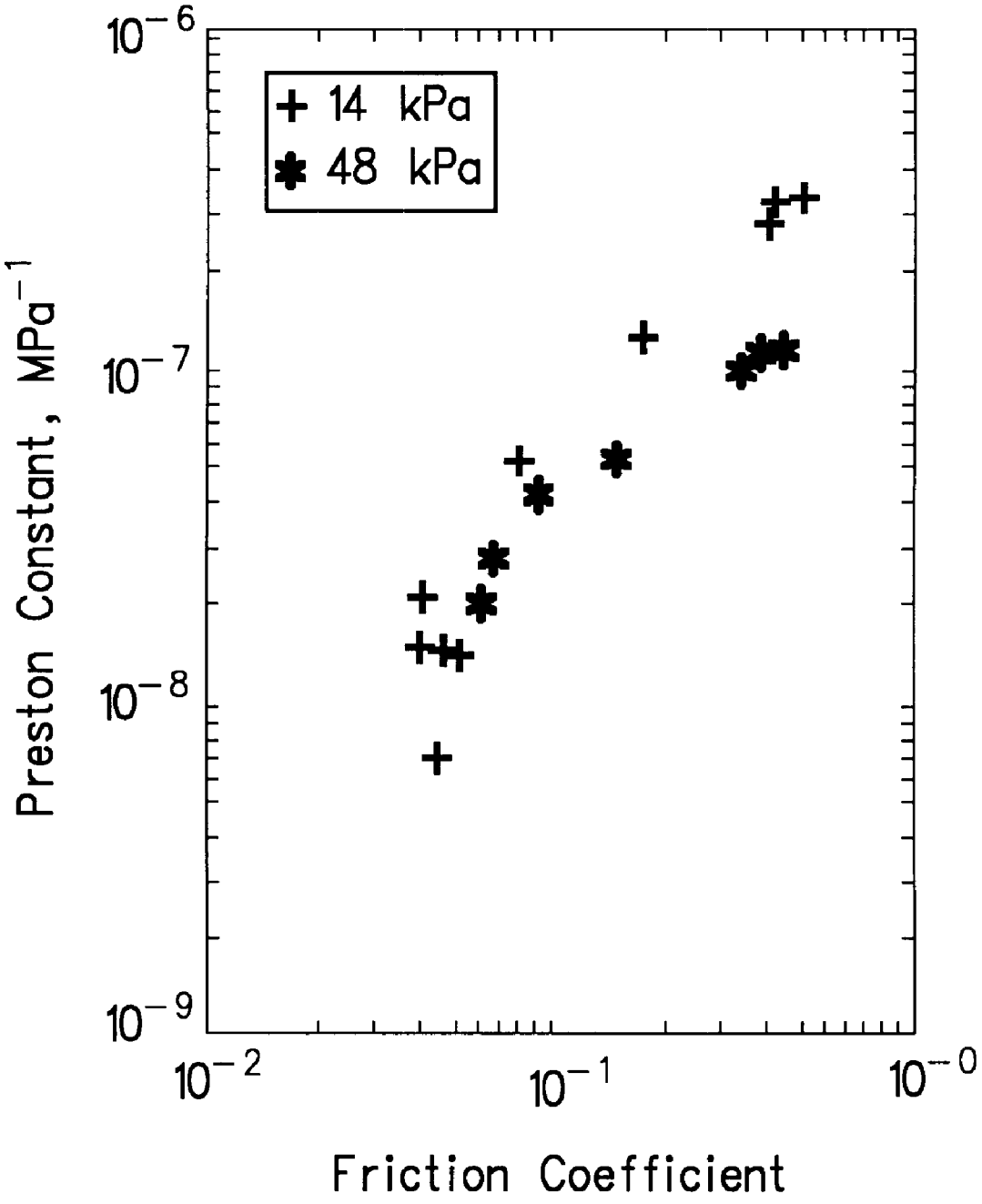
FIG. 6 shows the correlation between the Preston constant and the friction coefficient.

A cross plot of the Preston constant versus friction coefficient is shown in FIG. 6. Before the transition point, i.e., at the beginning of the mixed mode, the Preston constant and friction coefficient are positively correlated; the correlation coefficient is almost 1. However, the Preston constant shows less correlation with friction coefficient with an increase of $\eta v_R/p$ in the mixed mode. FIG. 4B further emphasizes the variation in the material removal rates with different contact modes. Thus, contrary to the prior art and the conventional teachings, the Preston constant is not truly constant over the different contact regimes.

Figure 7:
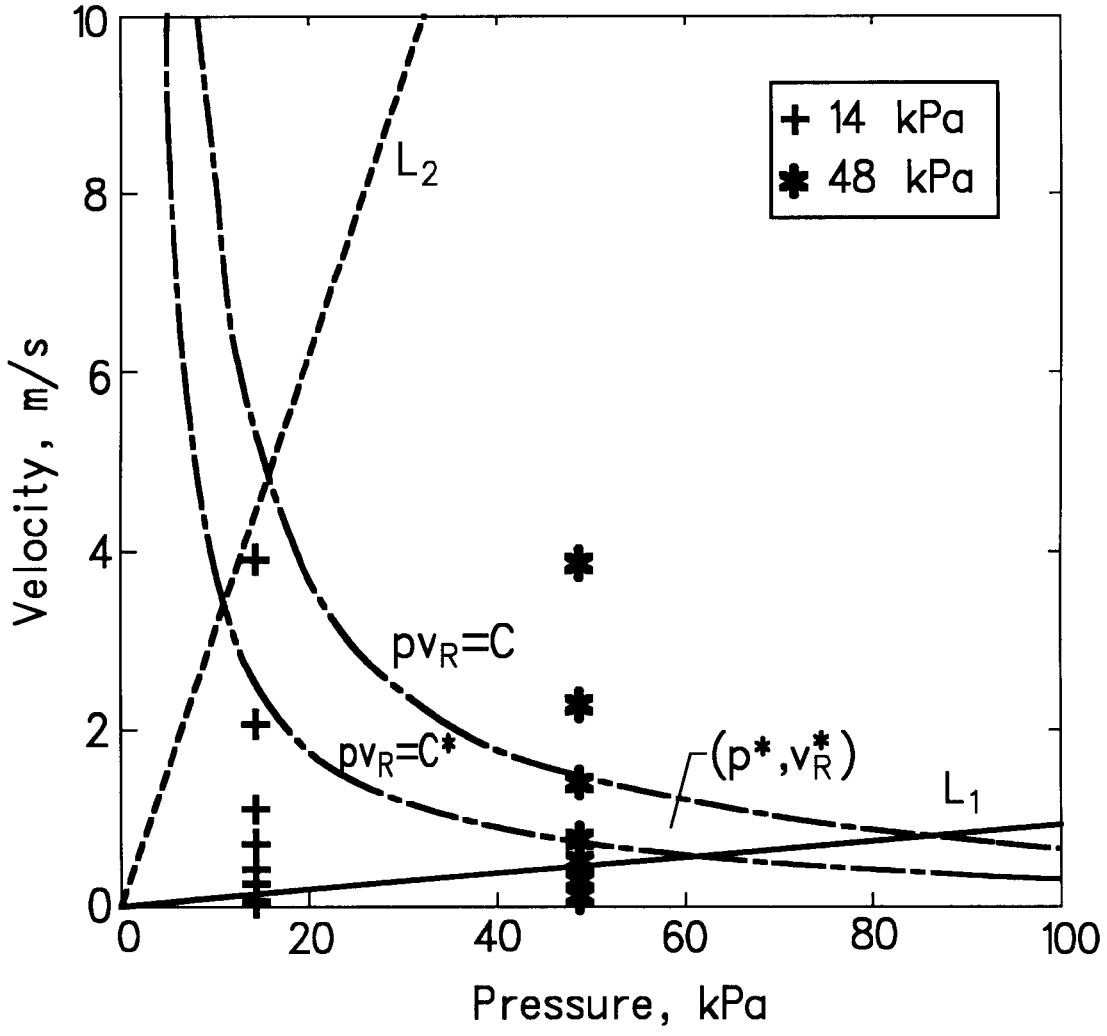
FIG. 7 illustrates the velocity as a function of pressure and shows preferred parameters that may be selected according to one aspect of the present invention.

Of particular advantage, the method of the present invention employs the effects of the parameter $\eta v_R/p$ on the friction coefficient and the Preston constant to promote increased material removal in the CMP process. For a certain slurry viscosity, the different wafer/pad contact regimes are delineated in the $v_R$–p space as shown in FIG. 7. Corresponding to the point $(\eta v_R/p)_c$ for transition from the contact mode to the mixed mode (see FIG. 5), a line $L_1$ with the slope $(\eta v_R/p)_c$ is drawn in FIG. 7 to represent the transition points for different pressures and velocities. The region bounded by $L_1$ and the p-axis represents the contact mode. Similarly, another line, $L_2$, with a greater slope to represent the transition from the mixed mode to the hydroplaning mode is drawn. The region bounded by $L_2$ and the $v_R$ -axis represents the hydroplaning mode. The region bounded by $L_1$ and $L_2$ represents the mixed mode. According to the present invention, the CMP process is carried out in the contact mode, i.e. the region bounded by $L_1$ and the p-axis in FIG. 7. In particular, the method of the present invention provides for carrying out the CMP process according to the following equation:

$$v_R/p \approx C_1/\eta \quad (1)$$

where $v_R$ is the relative velocity of the polishing pad and the wafer, p is the pressure applied to the wafer, and $C_1$ is a constant that is related to the geometry of the polishing interface and machine design, and $\eta$ is the viscosity of the slurry used in the particular CMP process. In one example of the present invention, $C_1$, is in the range of about: $1\times10^{-31}$ 7 to $1\times10^{-6}$ meters.

In the preferred embodiment, in addition to increasing the MRR, the present invention provides for reducing the within-wafer non-uniformity (WIWNU). The WIWNU is the degree of non uniformity of the layers of material across the surface of the wafer. Referring again to Eq. (1), the $pv_R$ product should be as high as possible to increase the MRR, i.e., the highest velocity available is preferable in the contact regime for a given pressure, and vice versa. This suggests that the preferred processing conditions are located on the line $L_1$. However, a high pressure requires a sturdy machine structure, which generally sets an upper limit for the applicable pressure. Further, at a high pressure even a small vibration of the machine might result in large fluctuations on the normal load and friction force at the wafer/pad contact interface, and thus increase the WIWNU. These considerations suggest that the pressure increase cannot be unlimited. Similarly, extremely high velocities are not desirable because it is difficult to retain the fluid slurry on the platen at high velocities.

The inventors have discovered that an even a more important consideration for the process parameters of pressure and velocity is that of heat generation. The rate of thermal energy generation due to friction, P, can be expressed as $$P = \mu t \pi r_w^2 p v_R \quad (2)$$

Thus, the higher the value of the product $pv_R$ is, the greater the amount of heat generation. Based on experiments conducted by the inventors, the typical value of heat generation rate for a 100 mm diameter Cu wafer polished at 48 kPa normal pressure and a velocity of 0.5 m/s and is about 80 W. The frictional heat generation will raise temperature and vary the chemical reaction rates locally, and thus deteriorates the polishing uniformity. In the contact mode, the heat generated is not efficiently removed by the slurry transport since the volume flow rate through the interface is rather low. Even with external cooling of the pad and the wafer carrier, the heat removal rate can be limited due to the low thermal conductivities of the silicon wafer and the polishing pad which is typically made from polyurethane. To address this issue of heat generation, one embodiment of the present invention provides for establishing an upper limit for the applicable $pv_R$ product. This upper limit for heat generation is set as $pv_R=C_2$, where $C_2$ is a constant that depends the interfacial friction coefficient and the thermal conductivity of the backing film and the pad, and the cooling system of the head and the platen. The constraint $pv_R=C_2$ is shown as a rectangular hyperbola in FIG. 7.

A preferred process condition ($p^*$, $v_R^*$) may be defined by the intersection of $pv_R=C_2^*$ with $L_1$. Operation of the CMP process in the mixed and hydrodynamic modes is not optimum for reasons cited earlier. It should be understood that the constant $C_2$ is not fixed, and that appropriate external cooling may be installed in the polishing head and the platen to improve the efficiency of heat removal and increase the constant $C_2$, and thus the exact preferred process conditions will change based on changes in the value of $C_2$. As $C_2^*$ is increased with additional cooling means such as external cooling, a higher MRR can be achieved by increasing the $P^*v_R^*$ product. Further, for other practical reasons (such as mechanical vibration, slurry retainment, and the like.), the actual most preferred pressure and velocity values can be somewhat different from $p^*$ and $v_R^*$; however, such actual most preferred values can be determined with routine experimentation based on the teaching of the present invention. For example, using friction force measurements during the CMP process and applying Eq. (2), one can characterize the contact regime, and then identify the transition point from contact mode to mixed mode, and determine the most preferred pressures and velocities for the particular CMP machine.

Thus, in another embodiment of the present invention, a method of chemical mechanical polishing is carried out such that the following equation is satisfied:

$$v_R P \leqq C_2 \tag{3}$$

where $v_R$ and p are as defined above and $C_2$ is dependent on the interfacial friction coefficient and the thermal conductivity of the backing film and the pad, and the cooling system of the head and platen. As described above $C_2$ is an upper limit which constrains the applied pressure and relative velocity parameters due to heat generation. Preferably this upper limit $C_2$ is selected such that the temperature rise from the heat generated from the products of $v_R p$, does not exceed about 10 degrees K (or ° C.) , and more preferably does not exceed about 5 degrees K.

The constant $C_2$ is dependent on the CMP machine configuration, and this will vary for each tool. The machine configuration variables which effect $C_2$ are related to heat generation and are primarily the interfacial friction coefficient, the thermal conductivities of the pad and its backing film, and the cooling system (i.e. the thermal properties) of the wafer carrier head and the platen.

One example of how $C_2$ is determined is provided below. It is important to note as mentioned above that $C_2$ will vary depending on each specific CMP tool configuration and is thus in no way limited by the following example, and $C_2$ can be determined based on the teaching herein.

It is assumed that a portion of the frictional heat, $\alpha Q$, is transferred into the pad, where $\alpha$ is the fraction ($0<\alpha<1$) and Q is the total energy generated ($Q=P\cdot t$ , where t is the total CMP process time). Additionally, the pad is assumed to be adiabatic, i.e. all heat transferred into the pad will be stored in the pad and increases the temperature without dissipating into environment. This is a "worse case" estimation. It can be further assumed that the temperature raise, $\Delta T$, is uniform in the pad and is given by $$\alpha Q = mC\Delta T \tag{4}$$

where m is the mass of the pad, and C is the specific heat of the pad.

Combined with Eq. (2), the constant $C_2$ in Eq (3) to define the maximum $pv_R$ product in one example can be determined as:

$$C_2 = \frac{mC\Delta T}{a\mu\pi r_w^2 t} \tag{5}$$

where are terms are as defined above. The value of the factor a between 0 and 1, must be determined by experimental measurement. During the CMP process, most of the heat is transferred into the slurry and $\alpha$ is small. For instance, in one example if we assume that a 0.1, m=0.1 kg for 300 mm (12") pad, C=2100 J/kg·K, $\Delta T$ is less than 5 K (or ° C.), and t=2 min; then the value of $C_2$, which is the maximum $pv_R$ product, is about 27 $W/m^2$.

Thus, in summary, $C_1$ is used to determine the maximum kp and $v_R/p$ ratio which provides for carrying out the process in the contact regime, and $C_2$ provides an upper limit on the product of $v_R p$ to limit the amount of adverse heat generation. By doing so our goal is to increase the material removal rate and also to promote maintaining the WIWNU at a desired low level.

In another aspect of the present invention, the friction coefficient is measured and monitored to maintain the CMP process in the contact mode. As described above, the friction coefficient varies by one or two orders magnitudes among the different contact modes. Generally, the friction coefficient for contact mode will be in the range of about 0.1 or greater; for the mixed mode in the range of about 0.01 to 0.1, and for the hydrodynamic mode in the range of about 0.001 to 0.01. According to the present invention, this wide range in friction may be employed to monitor the contact conditions at the wafer/pad interface during the CMP process. In particular, friction in the system may be measured directly by sensing the load in the system and/or the torque. Torque sensors may be installed to measure the torque on the motor that rotates the wafer carrier head. Alternatively, or additionally, torque sensors may be installed to measure the torque on the motor that rotates the platen. Further, load sensors may be installed, preferably on the wafer carrier, to measure the load in the system. Preferably, the load sensors are installed to measure the frictional forces in two orthogonal directions on the plane in parallel with the pad surface. Measurements from these sensors are then processed to provide the friction coefficient using conventional means. To maintain the process in the contact mode, a controller may be used which adjusts the relative velocity and/or applied pressure responsive to the torque and load sensor measurements.

Experimental

The following experiments have been conducted. These experiments are provided for purposed of illustration, and are in no way intended to limit the invention in any way. Experiments on Cu blanket wafers with neutral $Al_2O_3$ slurry have been conducted to verify the models for a wide range of pressure and velocity settings.

A rotary-type polisher, as well known in the art, was employed in the polishing experiments. The stainless steel wafer carrier was connected to a head motor by a gimbaling mechanism to align the wafer parallel to the platen surface. Two load sensors and a torque sensor were installed to measure the frictional forces in two orthogonal directions and the torque of the head motor. The capacities of the load and the torque sensors are 222 N and 5.65 N·m, and the resolutions are 0.067 N and 0.001 N·m, respectively. The head unit was driven by pneumatic pistons for vertical motion and for applying normal pressure. The platen unit is composed of a detachable 300 mm dia. aluminum platen and a platen motor. Surfaces of the aluminum platen and the base were ground to achieve a high degree of flatness and surface finish. The polisher was computer controlled so that the applied load, rotational speeds of the wafer carrier and of the platen could be controlled independently, and the forces and torques on the wafer could be acquired in real time. The entire apparatus was housed inside a laminar flow module equipped with HEPA filters to ensure a contaminant-free environment.

Silicon wafer substrates, 100 mm in diameter, coated with 20 nm TiN as adhesion layer and 1 $\mu$m PVD Cu on the top were used as test wafers. The density and hardness of the coating materials are listed in Table 1. A neutral slurry (pH =7) with $Al_2O_3$ abrasive particles was used. The viscosity of the slurry was about 0.03 Pa. Additional properties are shown below in Table 2.

TABLE 1

Density and Hardness of Experimental Materials

| Material | Density (kg/m3) | Hardness (MPa) |
|---|---|---|
| Cu | 8,920 | 1,220 ± 50 |
| TiN | 5,430 | 17,640 ± 1,235 |
| Si | 2,420 | 8,776 ± 570 |

TABLE 2

Properties of the Slurry

| | |
|---|---|
| Abrasive | $\alpha$-$Al_2O_3$ |
| Particle Size ($\mu$m) | 0.3 |
| Particle Hardness (Mpa) | 20,500 |
| Concentration (vol. %) | 2–3 |
| Viscosity (Pa s) | 0.03 |
| pH | 7 |

A commercial composite pad (Rodel IC1400) was employed in the polishing experiments. The pad comprised a micro porous polyurethane top layer (Rodel IC1000) and a high-density urethane foam as underlayer. The room temperature elastic moduli of the top pad and the composite pad were about 500 MPa and 60 MPa, respectively. Further details of the pad are listed in Table 3.

TABLE 3

Pad Properties

| | |
|---|---|
| Pad | Rodel IC1400 (k-grooving) |
| Material | Polyurethane |

TABLE 3-continued

Pad Properties

| | |
|---|---|
| Thickness (mm) | 2.61 (1.27*) |
| Density (kg/m3) | 750* |
| Hardness | 57 shore D* |
| Pore Size ($\mu$m) | 20–60 (isolated)* |
| Groove Pattern | 250 $\mu$m wide, 375 $\mu$m deep with a 1.5 mm pitch, concentric |

*Top pad (IC1000)

Table 4 lists the experimental conditions employed in this study:

TABLE 4

Experimental Conditions

| | |
|---|---|
| Normal Load (N) | 108,379 |
| Normal Pressure (kPa) | 14, 48 |
| Angular Speed (rpm) | 5–420 |
| Linear Velocity (m/s) | 0.05–3.91 |
| Slurry Flow Rate (ml/min) | 150–250 |
| Duration (min) | 2 |
| Sliding Distance (m) | 6–469 |
| Ambient Temperature (° C.) | 22 |
| Relative Humidity (%) | 35–45 |

Each wafer was weighed before and after polishing to calculate the average material removal rate (MRR). The worn pad surface and Cu-coated wafer surfaces were observed in a scanning electron microscope (SEM) to characterize the post-CUT pad topography and surface scratches on wafers.

The effects of process parameters on the material removal rate, and the, relations between the friction coefficient and Preston constant are examined. The results show that Preston constant is independent of the pressure and velocity only in the contact regime. Moreover, the high correlation between the friction coefficient and Preston constant in the contact mode allows the use of monitoring the friction coefficient in-situ to monitor the removal rate during the CMP process. As illustrated, the MRR is increased when operating in the contact mode as provided by the present invention.

The foregoing description of specific embodiments and examples of the invention have been presented for the purpose of illustration and description, and although the invention has been illustrated by certain of the preceding examples, it is not to be construed as being limited thereby. They are not intended to be exhaustive or to limit the invention to the precise forms disclosed, and obviously many modifications, embodiments, and variations are possible in light of the above teaching. It is intended that the scope of the invention encompass the generic area as herein disclosed, and by the claims appended hereto and their equivalents.

We claim:

1. A method of chemical mechanical polishing a surface of a wafer with a polishing pad, comprising the steps of:

rotating any one or both of the polishing pad and the wafer at a relative velocity $v_R$; and urging the wafer and pad against each other at an applied pressure p;

wherein the values of p and $v_R$ are such that the interface between the pad and the wafer are in the contact mode and heat generated during polishing of the wafer does not exceed about 10 degree K.

2. The method of claim 1 further comprising:

measuring the frictional forces generated by the pad and wafer during the polishing.

3. The method of claim 2 further comprising:

determining the friction coefficient from said friction measurement; and controlling the values of p and $v_R$ to maintain the friction coefficient at a value of about 0.1 or greater.

4. The method of claim 1 wherein the value of p is in the range of about 14 to 70 kPa.

5. The method of claim 1 wherein the value of p is in the range of about 14 to 57 kPa.

6. The method of claim 1 wherein the value of $v_R$ is in the range of about 0.05 to 4.0 m/s.

7. The method of claim 1 wherein the value of $v_R$ is in the range of about 0.4 to 2.0 m/s.

8. A method of chemical mechanical polishing a surface of a wafer with a polishing pad, comprising the steps of:

rotating any one or both of the polishing pad and the wafer at a relative velocity $v_R$;

urging the wafer and pad against each other at an applied pressure p, measuring the frictional forces generated by the pad and wafer during the polishing;

determining the friction coefficient from said friction measurement; and controlling the values of p and $v_R$ to maintain the friction coefficient at a value of about 0.1 or greater during polishing and heat generated during polishing of the wafer not to exceed about 10 degree K.

9. The method of claim 1 wherein the values of p and $v_R$ are selected such that heat generated during polishing of the wafer does not exceed about 5 degrees K.

10. A method of chemical mechanical polishing a surface of a wafer with a polishing pad and a slurry at a polishing interface in a CMP machine, comprising the steps of:

rotating any one or both of the polishing pad and the wafer at a relative velocity $v_R$; and urging the wafer and pad against each other at an applied pressure p, and wherein the values of p and $v_R$ satisfy the following relationship:

$$v_R/p \approx C_1/\eta \quad (1)$$

where $C_1$ is a constant and is a function of the geometry of the polishing interface and the design of the CMP machine and $\eta$ is the viscosity of the slurry;

such that the interface between the pad and the wafer are in the contact mode.

11. The method of claim 10 wherein $C_1$ is in the range of about $1\times10^{-7}$ to $1\times10^{-6}$ meters.

12. The method of claim 10 further comprising:

determining the friction coefficient from measuring the frictional forces between the wafer and the pad; and controlling the values of p and $v_R$ to maintain the friction coefficient at a value of about 0.1 or greater.

13. The method of claim 10 wherein the value of p is in the range of about 14 to 70 kPa.

14. The method of claim 10 wherein the value of p is in the range of about 14 to 57 kPa.

15. The method of claim 10 wherein the value of $v_R$ is in the range of about 0.05 to 4.0 m/s.

16. The method of claim 10 wherein the value of $v_R$ is in the range of about 0.4 to 2.0 m/s.

17. A method of chemical mechanical polishing a surface of a wafer with a CMP machine including a polishing pad and a slurry, comprising the steps of:

rotating any one or both of the polishing pad and the wafer at a relative velocity $v_R$; and urging the wafer and pad against each other at an applied pressure p, and wherein the values of p and $v_R$ satisfy the following relationship:

$$v_R/p \approx C_1/\eta$$

where $C_1$ is a constant and is a function of the geometry of the polishing interface and the design of the CMP machine and $\eta$ is the viscosity of the slurry; and $$v_R P \leqq C_2 \quad (3)$$

where $v_R$ and p are as defined above and $C_2$ is selected such that heat generation from the wafer/pad interface does not exceed about 10 K.

* * * * *